US005948206A

United States Patent [19]

Inaba et al.

[11] Patent Number: 5,948,206

[45] Date of Patent: Sep. 7, 1999

[54] APPARATUS FOR DETERMINING REMOVED AMOUNT OF WAFER

[75] Inventors: Takao Inaba; Minoru Numoto, both of Mitaka, Japan

[73] Assignee: Tokyo Seimitsu Co., Ltd., Tokyo, Japan

[21] Appl. No.: 08/992,257

[22] Filed: Dec. 17, 1997

[30] Foreign Application Priority Data

Dec. 17, 1996 [JP] Japan ..... 8-336716

[51] Int. Cl.[6] ..... C23F 1/02; B44C 1/22; H01L 21/302

[52] U.S. Cl. ..... 156/345; 216/84; 216/86; 216/88; 438/691; 438/17; 438/14

[58] Field of Search ..... 156/345; 438/691, 438/692, 14, 17, 18; 216/84, 86, 88, 89

[56] References Cited

U.S. PATENT DOCUMENTS 5,213,655 5/1993 Leach et al. ..... 156/627
5,559,428 9/1996 Li et al. ..... 324/71.5
5,834,645 11/1998 Bartels et al. ..... 73/105

FOREIGN PATENT DOCUMENTS 61-274876 12/1986 Japan .
7-307317 11/1995 Japan .
9-057613 3/1997 Japan .

*Primary Examiner*—William Powell
*Assistant Examiner*—George Goudreau
*Attorney, Agent, or Firm*—Sixbey, Friedman, Leedom & Ferguson; David S. Safran

[57] ABSTRACT

The differential transformer is secured to the wafer holding table provided in the head, and the core of the differential transformer is secured to the rod member, which is provided to the head and freely projects and retracts from the face of the wafer. Then, the tip of the rod member is in contact with the polishing pad and keeps the core at a constant height from the polishing pad during polishing. When the head is displaced as polishing progresses with respect to the polishing pad, the differential transformer is displaced in connection with the displacement of the head. Therefore, the removed amount of the wafer can be determined by measuring the displacement amount of the differential transformer with respect to the core.

1 Claim, 2 Drawing Sheets

APPARATUS FOR DETERMINING REMOVED AMOUNT OF WAFER

BACKGROUND OF THE INVENTION

1. Field of the Invention

The present invention relates to an apparatus for determining a removed amount of a wafer, and more particularly to an apparatus for determining a removed amount of a wafer during processing in a grinding/polishing apparatus which grinds or polishes a face of the wafer by moving a wafer holding table which holds the wafer thereon and a grinding/polishing member relatively to one another while pressing the face of the wafer against the grinding/polishing member.

2. Description of Related Art

To determine thickness variations (a removed amount) of a wafer during polishing of the wafer, in a polishing apparatus for polishing a surface of a wafer such as a semiconductor wafer, is important for detecting the end point of the polishing of the wafer, improving the quality of the polished wafer, and performing the closedloop control of the apparatus.

In the conventional polishing apparatus such as a chemical mechanical polishing (CMP) apparatus, since the direct measurement for the thickness variations of the wafer is difficult, the removed amount of the wafer is estimated by means of electric current variations of a motor which drives a turn table, on which a polishing pad is provided, or a wafer fixing spindle (the motor current measuring method). In this method, however, there is a disadvantage in that accuracy of estimation is poor because the estimation is very indirect.

In a polishing apparatus which polishes a wafer while moving a wafer holding table, which holds the wafer thereon, toward the polishing pad, the removed amount of the wafer can be estimated by means of positional variations of the wafer holding table. In this method, it is required that the position of a polishing face of the polishing pad is constant during polishing; however, the position of the polishing face varies as a result of a warp of the turn table and wear of the polishing pad. Then, the removed amount of the wafer can not be determined accurately by means of the positional variations of the wafer holding table only.

SUMMARY OF THE INVENTION

The present invention has been developed in view of the above-described circumstances, and has as its object to provide an apparatus which can accurately and directly determine the removed amount of a wafer during grinding/polishing.

To achieve the above-described objects, in a grinding/polishing apparatus for grinding/polishing a wafer by moving a wafer holding table which holds the wafer thereon and a grinding/polishing member relatively to one another while pressing a face of the wafer against a face of the grinding/polishing member, an apparatus of the present invention for determining a removed amount of the wafer comprises: a differential transformer including a coil and a core, the coil moving in connection with the wafer holding table; a supporting member for supporting the core of the differential transformer so as to keep the core at a constant height from the face of the grinding/polishing member; and the apparatus is characterized in that the removed amount of the wafer is determined by measuring a displacement amount of the coil with respect to the core during grinding/polishing of the wafer.

According to the present invention, the core of the differential transformer is kept at a constant height from the face of the grinding/polishing member, and the coil of the differential transformer is moved in connection with the wafer holding table. Thus, during grinding/polishing of the wafer, the removed amount of the wafer can be determined directly and accurately by measuring the displacement amount of the coil with respect to the core, that is, the displacement amount of the wafer holding table with respect to the face of the grinding/polishing member.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Detailed description will hereunder be given of the preferred embodiments of the apparatus for determining a removed amount of a wafer according to the present invention with reference to the accompanying drawings.

Figure 1:
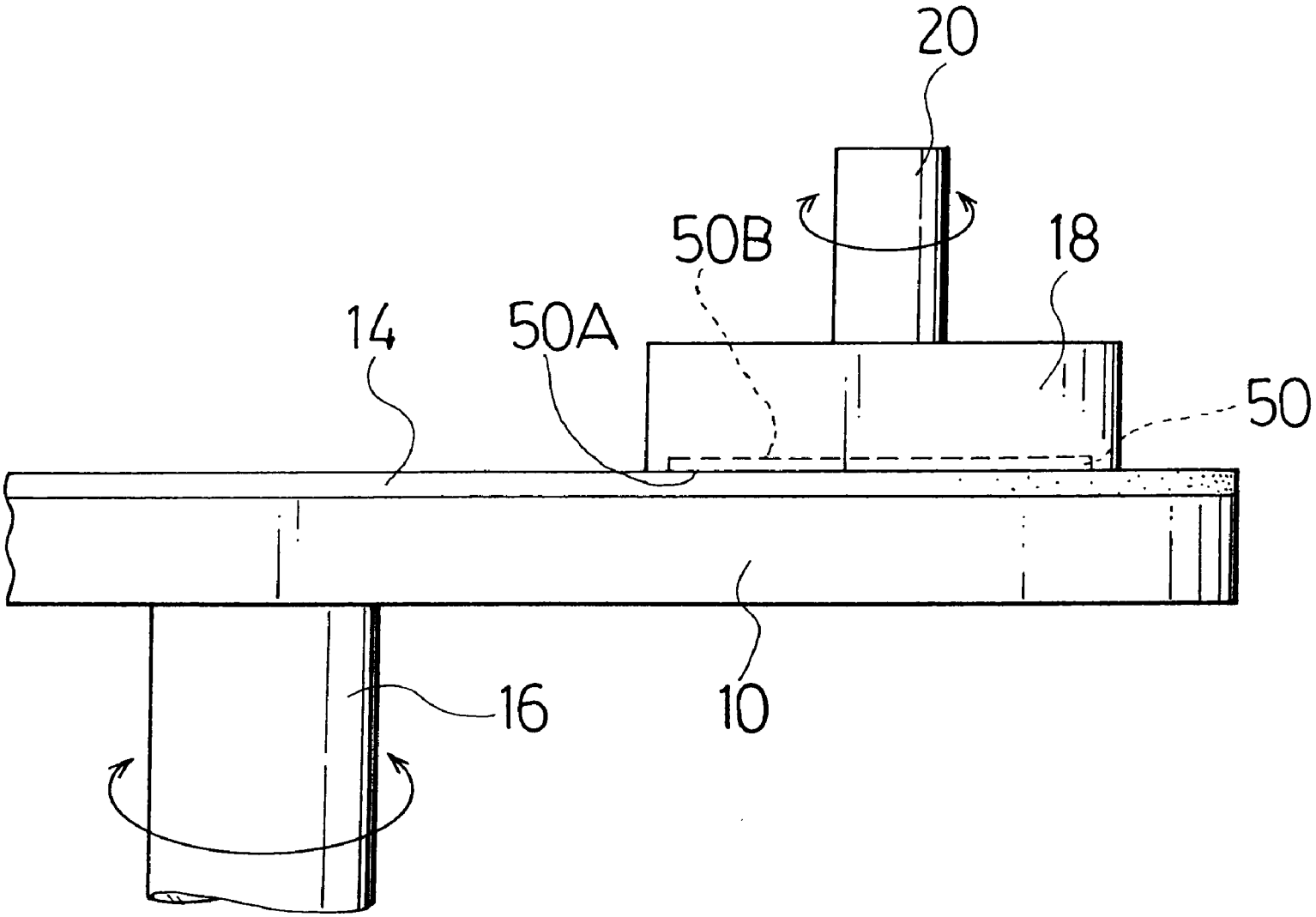
FIG. 1 is a view illustrating the construction of a wafer polishing apparatus to which an embodiment of an apparatus for determining a removed amount of a wafer according to the present invention is applied.

FIG. 1 is a view illustrating the construction of a wafer polishing apparatus to which an embodiment of the apparatus for determining a removed amount of a wafer according to the present invention is applied. As shown in FIG. 1, the wafer polishing apparatus is provided with a turn table 10 and a head 18. The head 18 holds a wafer 50 in a state that a face 50A, which is polished, is faced down and the other face 50B is held at the bottom of the head 18.

The turn table 10 is disk-shaped, and a polishing pad 14 for polishing the wafer 50 is attached to the top of the turn table 10. A spindle 16 is secured to the bottom of the turn table 10, and the spindle 16 is connected to a rotational axis of a motor (not shown). Then, the turn table 10 is rotated by rotating the motor, and the polishing pad 14 rotates.

A spindle 20 is secured to the top of the head 18, and the spindle 20 is connected to a rotational axis of a motor (not shown). Then, the head 18 is rotated by rotating the motor, and the wafer 50 which is held by the head 18 rotates. The head 18 is moved up and down by a driving mechanism (not shown), so that the wafer 50 which is held by the head 18 can be moved down toward the turn table 10 and pressed against a surface of the polishing pad 14.

According to the above-described construction, the wafer 50 and the polishing pad 14 rotate, and the wafer 50 is pressed against the polishing pad 14, so that the wafer 50 is polished. During polishing, a slurry (polishing liquid) is supplied between the wafer 50 and the polishing pad 14.

Figure 2:
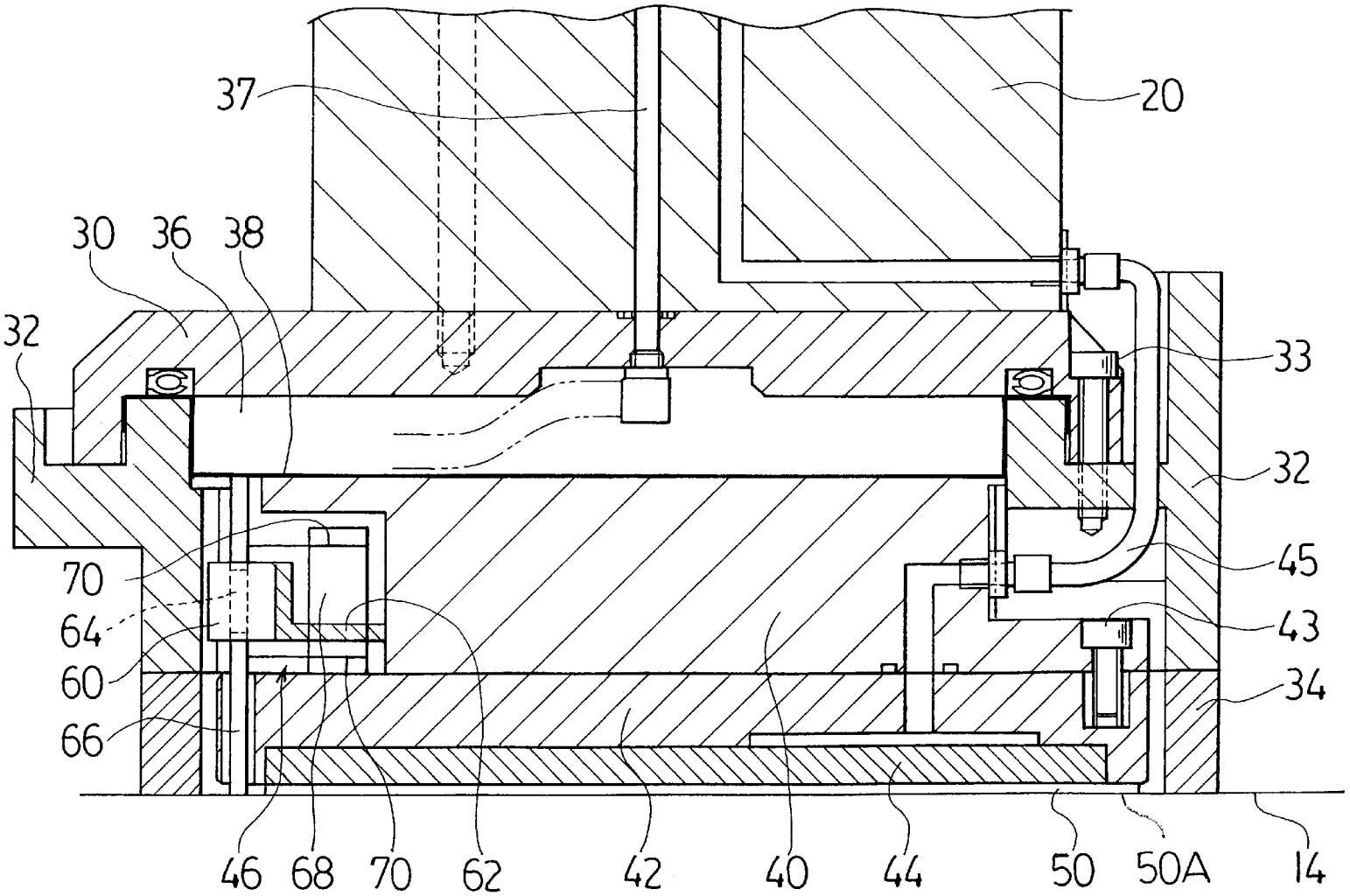
FIG. 2 is a section view illustrating a head of the polishing apparatus in FIG. 1.

FIG. 2 is a section view of the head 18 illustrating the construction of the embodiment of the apparatus for determining a removed amount of a wafer according to the present invention.

As shown in FIG. 2, the head 18 has a base plate 30 at the top, and the base plate 30 is fixed to the spindle 20. Thus, the head 18 is fixed to the spindle 20. The head 18 has a guide ring 32 at its periphery, and the guide ring 32 is fixed to the base plate 30 with a screw 33.

A retainer ring 34 is attached to the bottom of the guide ring 32, and a periphery of the wafer 50 is surrounded by the retainer ring 34. When the wafer 50 is pressed against the polishing pad 14 during polishing, the retainer ring 34 is also pressed against the polishing pad 14, and thus the elastic stress of the polishing pad 14, that is, the polishing pressure can be prevented from concentrating on a edge of the wafer 50.

An air chamber 36 is formed at the bottom of the base plate 30. The air chamber 36 is sealed with an elastic film 38, which is held between the base plate 30 and the guide ring 22. The internal pressure of the air chamber 36 is regulated to be a proper pressure by a pressure regulating apparatus (not shown) via an air supply passage 37 communicating with the air chamber 36.

A columnar member 40 engages with the bottom of the air chamber 36. The columnar member 40 is anchored at the guide ring 32 by a fall-out prevention pin (not shown) so that the columnar member 40 can slightly move up and down with respect to the guide ring 32. Then, a carrier 42 is fixed to the bottom of the columnar member 40 with a screw 43, and a wafer holding table 44 is secured to the bottom of the carrier 42. The wafer holding table 44 holds the wafer 50 on its bottom side by pulling the wafer 50 from the other side by means of a vacuum apparatus (not shown) via a vacuum passage 45.

The inner pressure of the air chamber 36 is transmitted to the columnar member 40 via the elastic film 38. The pressure which is transmitted to the columnar member 40 is then transmitted to the wafer 50 via the carrier 42 and the wafer holding table 44. Then, by regulating the inner pressure of the air chamber 36 with the pressure regulating apparatus, the pressing force applied to the wafer 50 can be adjusted; for example, the wafer 50 can be polished while pressing the wafer 50 against the polishing pad 14 by a constant pressure.

A differential transformer 60 including a coil (not shown) is housed in a cavity 46, which is provided at the top of the carrier 42. The differential transformer 60 is secured to the columnar member 40 through a supporting member 62.

On the other hand, a core 64 of the differential transformer 60 is secured to a rod member 66. The rod member 66 is inserted to a hole formed at the carrier 42, and is able to project and retract freely through the hole. The rod member 66 is attached to parallel springs 70, which are supported by a supporting member 68 secured to the carrier 42.

The rod member 66 is usually supported by the parallel springs 70 so that the tip of the rod member 66 projects from the face 50A of the wafer 50. However, when the head 18 is moved down so as to press the face SOA of the wafer 50 against the polishing pad 14, the tip of the rod member 66 comes in contact with the polishing pad 14 before the face 50A of the wafer 50 comes in contact with the polishing pad 14, and at the same time the tip of the rod member 66 is pushed-in against the force of the parallel springs 70. Thereby, the core 64, which is secured to the rod member 66, is displaced with respect to the differential transformer 60, that is, the coil within the differential transformer 60.

Thus, during polishing, the displacement amount of the head 18 with respect to the polishing pad 14 from a point in time that the face 50A of the wafer 50 comes in contact with the polishing pad 14, that is, the removed amount of the wafer 50 can be determined by means of signals output from the differential transformer 60.

As described above, the differential transformer 60 is secured to the columnar member 40 via the supporting member 68; however, the differential transformer 60 may be secured to the guide ring 32.

Moreover, in the above-described embodiment, the wafer polishing apparatus which performs polishing by moving the wafer holding table 44 (the head 18) which holds the wafer 50 is described; but the present invention is not limited to that. The apparatus of the present invention can also be applied to a wafer polishing apparatus which performs polishing by moving the turn table 10 with respect to the wafer 50. Further, the apparatus of the present invention can also be applied to a wafer grinding apparatus for grinding a wafer which has a similar construction with the wafer polishing apparatus.

As described above, according to the apparatus for determining a removed amount of a wafer according to the present invention, the core of the differential transformer is held at a constant height from the grinding/polishing face of the grinding/polishing member by the supporting member, and the coil of the differential transformer is moved in connection with the wafer holding table. Thus, the removed amount (the amount of grinding/polishing) of the wafer can be determined directly and accurately from the displacement amount of the coil with respect to the core of the differential transformer during grinding/polishing. Thereby throughput and accuracy for grinding/polishing can be improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. In a grinding/polishing apparatus for grinding/polishing a wafer by moving a wafer holding table which holds the wafer thereon and a grinding/polishing member relatively to one another while pressing a face of the wafer against a face of said grinding/polishing member, an apparatus for determining a removed amount of the wafer comprising:

a differential transformer including a coil and a core, said coil moving in connection with said wafer holding table;

a supporting member for supporting said core of said differential transformer so as to keep said core at a constant height from said face of said grinding/polishing member; and wherein the removed amount of the wafer is determined by measuring a displacement amount of said coil with respect to said core during grinding/polishing of the wafer.

* * * * *